US005938358A

United States Patent [19]

Joulia

[11] Patent Number: 5,938,358

[45] Date of Patent: Aug. 17, 1999

[54] PACKAGING AND APPLICATION DEVICE FOR A FRIABLE PRODUCT

[75] Inventor: Gerard Joulia, Paris, France

[73] Assignee: L'Oreal, Paris, France

[21] Appl. No.: 08/968,452

[22] Filed: Nov. 12, 1997

[30] Foreign Application Priority Data

Nov. 12, 1996 [FR] France ..... 96 13758

[51] Int. Cl.[6] ..... A45D 40/06; A45D 40/12

[52] U.S. Cl. ..... 401/78; 401/74; 401/80; 401/87

[58] Field of Search ..... 401/78, 74, 80, 401/86, 87

[56] References Cited

U.S. PATENT DOCUMENTS

| | | | |
|---|---|---|---|
| 2,256,644 | 9/1941 | Houlihan | 401/78 X |
| 2,777,572 | 1/1957 | Cusack . | |
| 2,798,598 | 7/1957 | Abbotts | 401/78 |
| 2,921,675 | 1/1960 | Clark et al. . | |
| 3,512,896 | 5/1970 | Gruska | 401/80 X |
| 4,166,707 | 9/1979 | Zawacki, Jr. | 401/78 X |
| 4,750,501 | 6/1988 | Ackermann et al. . | |
| 4,984,919 | 1/1991 | Hultgren | 401/74 X |

FOREIGN PATENT DOCUMENTS

| | | |
|---|---|---|
| 92 916 | 1/1969 | France . |
| 2088333 | 6/1982 | United Kingdom . |

*Primary Examiner*—Steven A. Bratlie

*Attorney, Agent, or Firm*—Oblon, Spivak, McClelland, Maier & Neustadt, P.C.

[57] ABSTRACT

A device for the packaging and application of a friable product presented in the form of a lipstick including a tubular element with slide(s), wherein there is slidably mounted a cup intended to receive the lipstick, the cup having at least one stub engaged in a corresponding slide delimited by two longitudinal edges. A cylindrical shell provided with an internal helical groove has the tubular element freely rotatable inside it, with the stubs of the cup engaging in the helical grooves of the shell. Soft friction between the cup and the tubular element is ensured by a tangential elastic deformation of at least one of the longitudinal edges of a slide during the passing of the stub whose width is slightly larger than the width of the slide.

22 Claims, 2 Drawing Sheets

PACKAGING AND APPLICATION DEVICE FOR A FRIABLE PRODUCT

BACKGROUND OF THE INVENTION

1. Field of the Invention

The invention relates to a device for applying a pasty product, in particular a cosmetic product such as lipstick, presented in the form of a stick and slidably mounted in a case.

Such a stick of lipstick must be friable and is, for this reason, usually of a relatively soft consistency; this entails difficulties joining it to a support such as a cup for carrying the stick with a view to its application to the lips. Thus shocks during carriage, or vibrations during use, may cause the stick to break off at the level of the cup. Indeed, in most of the devices for the application of lip products, a more or less extensive play of the cup in the case may be observed. During the carriage of the case, for example in a handbag or during its use, the stick sways to and fro which may lead to its becoming disconnected from its support.

2. Description of the Related Art

It is known, in particular from FIG. 19*a* of EP-A-0 658 325, to provide a device aiming to reduce the vibrations of the stick during its use. This device comprises: a tubular element with slides, a cup intended to receive the stick of the product and being slidably mounted in the tubular element with two stubs of the cup engaged in the longitudinal slides; a cylindrical shell whose internal side is provided with helical grooves and which is fitted on the tubular element so as to be free for rotation relative to the tubular element, the stubs of the cup being engaged in the helical grooves of the shell; and means for providing soft friction between the cup and the tubular element, these friction means comprising at least one tongue which is flexible in the radial direction, is provided on the tubular element, and is capable of cooperating with a bearing surface of the cup.

However, the solution proposed by this document poses problems in its practical use, since the radial space left for the making and the deformation of the flexible tongue is reduced between the external sleeve and the cup. This space has a precise play necessary to ensure the guided sliding of the cup in the tubular element. Too great a deflection of the flexible tongue during the sliding of the cup in the tubular element, due to imperfections of the molding of the cup and/or of the tongue and/or of the tubular element, leads irretrievably to the jamming of the cup.

FR-A-1 501 043 describes a mechanism for a lipstick comprising a cup provided with diametrically opposed stubs and each engaged, one the one hand in an axial slide, and on the other hand in a helical groove. Each stub is provided with a slot capable of imparting to it radial elasticity capable of permitting friction of the stub either in the slide or in the helical groove. However, this arrangement does not make it possible to compensate for large dimensional variations between the stub and the slide, and the elasticity of a split stub is generally insufficient to ensure suitable friction.

In addition, from U.S. Pat. No. 2,777,572 there is known a mechanism for a lipstick comprising a tubular element provided with a first axial slot acting as a slide for a stub of a cup for the product. A second slot, parallel to the first, defines a tongue which becomes retracted inside the tubular element so as to rub elastically in a radial direction of the tubular element, on the side edge of the cup. Although friction on the cup can be obtained in the median zone of the tongue, vibrations of the cup in the high or low positions cannot be reduced or suppressed. Moreover, this arrangement produces an off-centering of the cup on the opposite side to the tongue, which has an adverse effect on the appearance of the device.

SUMMARY OF THE INVENTION

The object of the present invention is, in particular, to provide a device of the kind defined above which should be relatively simple to make and which, in particular, does not entail the risk of the cup being jammed. Moreover, the invention aims to suppress the wobbling and vibrations which occur during carriage and/or during use of the lipstick, irrespective of the position of the lipstick in the case. Thanks to the invention, the stick of the pasty product is then better protected against shocks.

The device in accordance with the invention for applying a friable product, in particular a cosmetic product, such as a lipstick presented in the form of a stick comprises: a tubular element with at least one slide provided with a longitudinal axis wherein there is slidably mounted a cup which is intended to receive the stick and comprises at least one stub engaged in a corresponding slide delimited by two longitudinal edges; a cylindrical shell having an internal side wherein there is provided at least one helical groove, and inside which shell a tubular element is freely rotatable, each stub of the cup engaging in a respective helical groove of the shell; and restraining means for ensuring soft friction between the cup and the tubular element. This device is characterized in that the soft friction is ensured by an elastic deformation of at least one of the longitudinal edges of at least one slide tangentially to the sides of the tubular element during the passing of the stub, and in that the width of said stub is slightly greater than the width of the slide. By means of this arrangement there is obtained a good tight hold of the stubs in the slide in a direction perpendicular to the generator radius of the developed surface of the tubular element at a given height. By way of example in a preferred embodiment the difference between the width of a stub and that of a slide is advantageously comprised from 0.0 mm to 0.3 mm and preferably from 0.08 to 0.15 mm.

Advantageously, the means for ensuring soft friction between the cup and the tubular element are constituted by one or several longitudinal strips constituting at least one of the edges of the slide or slides.

According to a first embodiment, this longitudinal strip is formed of an elastomeric material. The tubular element can then be obtained by duplex injection molding of two materials namely: an elastomeric material for the longitudinal strip or strips, and a rigid or semi-rigid thermoplastic material for the rest of the tubular element.

According to a second embodiment, the strip forming the slide is made of the same material as the tubular element. In this case, at least one slot is arranged in the tubular element over substantially the whole height of the slide or slides, the slot delimiting, together with a corresponding slide, an elastically deformable strip delimited on the one hand by a longitudinal edge of the slot and on the other hand by a longitudinal edge of the corresponding slide, the strip being capable of elastic deformation during the passing of the stub along the slide. Advantageously, each slot is arranged in the vicinity of each of the slides, so as to define for each slide an elastically deformable strip. To ensure sufficient elasticity of the strip during the passing of the stub in the slide, the width of the strip is from approximately 1 mm to approximately 5 mm. Thus it is possible to ensure a constant hold of the stub in the slide during the whole of its travel.

To balance the travel of the cup in the tubular shell, the shell is advantageously provided with two diametrically opposed longitudinal slides parallel to the longitudinal axis of the tubular shell. In this case the cup has two stubs, also disposed diametrically opposed so as to each engage in a corresponding slide.

By means of the two above mentioned arrangements, any vibrations or any wobbling of the cup is eliminated in the tubular element during carriage or during manipulation of the device.

Advantageously, the tubular element may, moreover, include a base with a closed bottom capable of reinforcing its rigidity and facilitating holding it.

Advantageously, the base of the tubular element forms axial stop means capable of cooperating with a lower end of the cylindrical shell, so as to limit the axial engagement of the tubular element in the cylindrical shell. Advantageously, the second end of the cylindrical shell abuts against an external bead carried at the end on the side of the tubular element remote from its base. Thus a rotational movement of the cylindrical shell relative to the tubular element is ensured while keeping these two parts axially in position.

The material used for the cylindrical shell comprising the helical grooves is chosen from the group comprising polystyrene, polyolefins, polyacetals, polyamides, and polyesters.

The material of the tubular element is advantageously a rigid or semi-rigid material, and is preferably chosen from the group comprising polyolefins, polystyrenes, acetates and cellulose propionates, vinyl polymers, polyacetals, and polyamides.

When the elastic strip is made of an elastomeric material, an elastomer is advantageously chosen which is capable of forming a solid bond with, the thermoplastic rigid or semi-rigid material of the rest of the tubular element by thermofusion. The tubular element made of two materials may be obtained using the duplex injection molding technology.

BRIEF DESCRIPTION OF THE DRAWINGS

Apart from the arrangements set out above, the invention consists of a certain number of other arrangements which will be discussed more explicitly below.

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
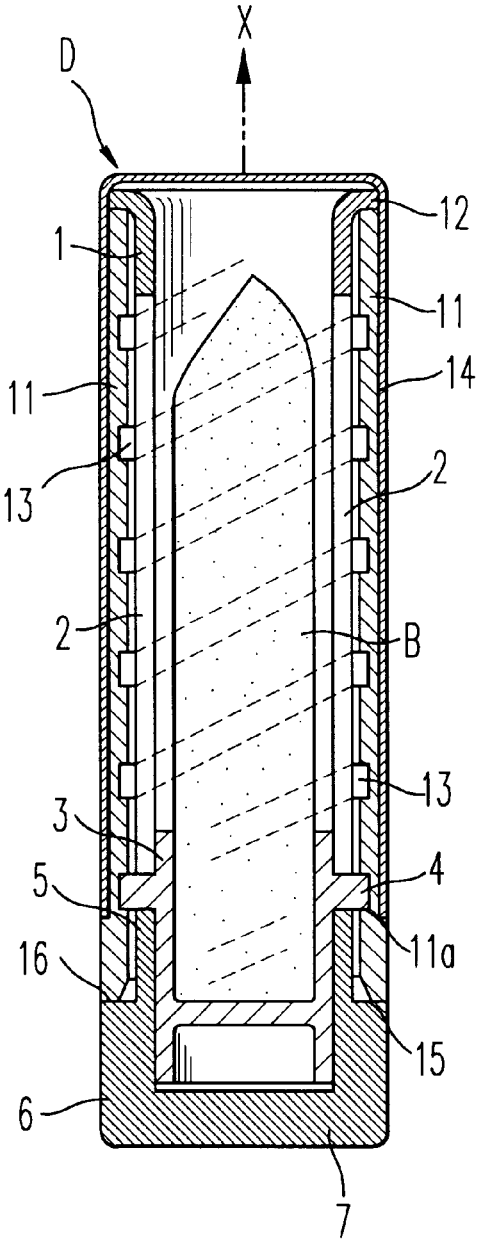
FIG. 1 is a longitudinal axial section of a device in accordance with the invention for applying lipstick in stick form.
Figure 2:
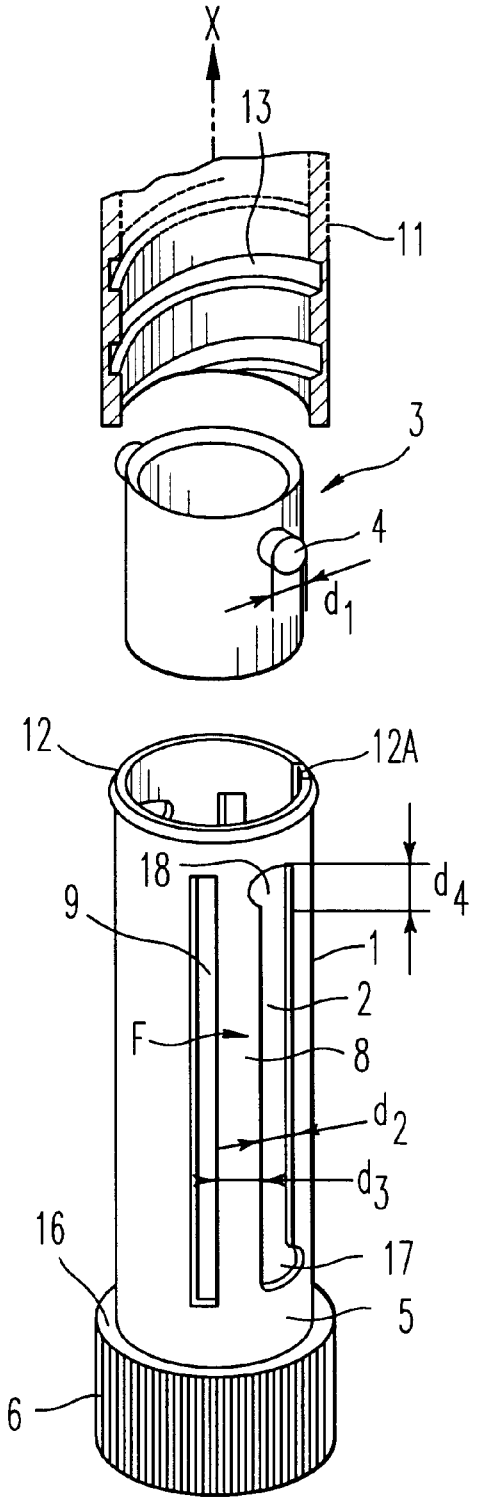
FIG. 2 is a perspective view of the tubular element of the device of FIG. 1 and of the cup carrying the stick.

Referring to FIGS. 1 and 2 there will be seen a device D for applying a pasty product formed by lipstick presented in the form of a stick B of a friable product. device D has a tubular element 1 with slides 2 each constituted by a longitudinal slot of width $d_2$ extending substantially from the bottom to the top along the direction of the generators of the element 1. Preferably, two diametrically opposed slides 2 are provided.

A cup 3 of a generally cylindrical shape is slidably mounted inside the tubular element 1. The base of the lipstick B is received and held tightly in position in the cup 3. This cup, of a cylindrical shape, has two diametrically opposed stubs 4 projecting radially outwardly. The stubs 4 are engaged in the slides 2 and pass through these slides, emerging at the external surface of the tubular element 1. These stubs 4 have a diameter $d_1$ which is slightly greater than the width $d_2$, of the slide 2. In the example in question, $d_1$ is of the order of 2.5 mm, whilst $d_2$ is approximately 2.4 mm. Thus the stubs are slightly squeezed in the slide 2. Generally, this squeezing action may correspond to a width difference $d_1-d_2$ of from 0.02 mm to 0.3 mm.

Soft friction means F are provided on the tubular element. As may be seen, in particular in FIG. 2, these soft friction means F include two flexible strips 8 provided over substantially the whole height of the tubular element 1, each strip 8 being in the shape of an elongate rectangle and being delimited on either side by the slide 2 and by a longitudinal slot 9 parallel to this slide 2. According to an alternative, a single strip 8 is provided which is associated with a single slide. Similarly, it is possible to associate two strips 8 on either side of each slide 2. Generally, the width $d_3$ of the strip 8 is chosen according to the rigidity of the material chosen for the making of the tubular element.

Thus the width $d_3$ of the strip 8 is from approximately 1 mm to approximately 5 mm. In particular, when the tubular element is made of polypropylene for example, $d_3$ is advantageously 2 mm.

The height of the strips 8 (that is to say their dimension along a direction parallel to the axis of the tubular element 1) is substantially equal to that of the slide 2.

Thanks to the soft means F, the play of the cup in the tubular element 1 is taken up in order to eliminate any wobbling of the cup during its sliding.

The result is an anti-vibration effect of the parts between them, and a protection of the stick B of the cosmetic product against being unfastened following shocks and shaking of the device D.

Each end of the slide 2 has a lateral cutout 17, 18 serving to ensure a position for locking the cup 3 when the cup is in a completely retracted position, or in a completely extended position. The width or diameter $d_4$ of each cutout 17, 18 substantially corresponds to the diameter $d_1$, of the stubs 4. The cutout 17 is orientated on the opposite side of the slide 2 from the cutout 18.

Beneath the slides 2, the tubular element 1 is extended in a cylindrical base 6 which is itself closed at its lower end by a transverse bottom 7 which enhances the rigidity of the base 6. The height of the base 6 is sufficient for accommodating the cup 3 in the bottom position when the stubs 4 are in the lateral cutouts 17.

A cylindrical shell 11 of a small thickness, made of a plastic material, is fitted over the tubular element 1. The shell 11 is axially retained in position in the upper portion by a flange 12 of the cylindrical element 1, over which flange the shell 11 passes during the engagement of the shell 11 on the element 1 by virtue of deformation of this element 1. This deformation is permitted, in particular because at least one slide 2 opens out in the upper portion and intersects the flange 12.

Together with the tubular element the base 6 forms a shoulder 16 on which the lower end 15 of the cylindrical shell 11 comes to bear. Thus the cylindrical shell 11 is axially fixed between the shoulder 16 and the flange 12, but is free for rotation relative to the tubular element 1.

On its internal side, the shell 11 has two helical grooves 13, offset by 180° and wherein the free ends of the stubs 4 are engaged. The grooves 13 open out in the bottom portion 11*a* of the shell 11 to permit, in particular, the engagement of the stubs 4 in the grooves. An external sleeve 14, generally made of metal, surrounds the shell 11 and is joined to the shell 11.

The functioning of the device D of FIGS. 1 and 2 follows directly from the above explanations.

For applying lipstick by means of the stick B, it is first of all necessary to hold the metal sleeve 14 in position and to cause the base to rotate relative to this sleeve so as to drive the tubular element 1 in rotation. The sleeve 14 remains stationary with the shell 1 and the cup 11 rises inside the tubular element by the displacement of the stubs 4 in the helical grooves 13.

During the rotational movement between the tubular element 1 and the shell 11, the strips 8 constantly exert an elastic bearing action against the stubs 4 to ensure a permanent take-up of the play and to give the rotational movement a quality of "softness", with a restraining effect and an antivibration effect.

Figure 3:
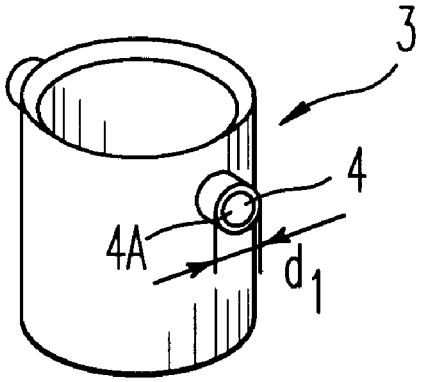
FIG. 3 is a perspective view of a cup having elastically deformable stubs.
Figure 4:
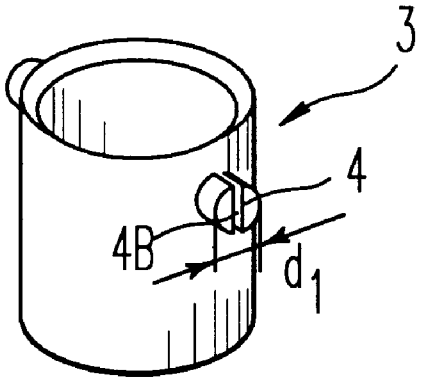
FIG. 4 is a perspective view of a variant of the embodiment of FIG. 3.

Alternatively, the soft friction is ensured by an elastic deformation of the stub 4 in the slide, the diameter $d_1$ of the stub in its rest position being slightly greater than the width of the corresponding slide. In such a configuration, the cup may be made by duplex injection of two materials namely: an elastomeric material for forming the stub or stubs and a rigid or semi-rigid material for the rest of the cup. According to another possibility, the elastic deformation of the stub 4 may be ensured by its structure. As may be seen in FIG. 3, the stub 4 is provided with a hollow center 4*a*, making it possible to reduce elastically the diameter $d_1$ of the stub in the corresponding slide. In a variant of the embodiment represented in FIG. 4, the stub 4 is traversed by a diametral slot 4*b* allowing the width of the stub to be reduced along a direction perpendicular to the slot 4*b*.

In the preceding detailed description, reference has been made to a preferred embodiment of the invention. It is obvious that variants may be introduced into it without departing from the spirit of the invention, as claimed below.

What is claimed as new and desired to be secured by Letters Patent of the United States is:

1. A device for packaging and application of a friable product comprising:

a tubular element with at least one longitudinal slide, said at least one slide having a width and a longitudinal edge;

a cup for receiving a lipstick slidably mounted to said tubular element;

said cup having at least one stub having a width and each said at least one stub engaged in a corresponding slide delimited by two longitudinal edges;

a cylindrical shell having an internal slide and at least one internal helical groove, said tubular element being freely rotatable inside said shell, each said at least one stub engaging in the respective groove of the shell;

restraining means to ensure a soft friction between the cup and the tubular element;

said soft friction ensured by elastic deformation of at least one slide tangential to the sides of the tubular element during the passing of said stub; and the width of said stub being slightly greater than the width of said slide.

2. A device according to claim 1, further comprising:

at least one slot having a longitudinal edge arranged in the tubular element over substantially the whole height of each slide, said at least one slot delimiting with a corresponding slide an elastically deformable strip, said strip being capable of elastic deformation during the passing of the stub along the slide.

3. A device according to claim 2, wherein a slot is arranged in the vicinity each of the slide, thereby defining an elastically deformable strip for each slide.

4. A device according to claim 1, wherein the cup comprises two stubs disposed in a diametrically opposed manner.

5. A device according to claim 1, wherein the difference between the width of each stub and the width of each slide is between 0.02 mm and 0.3 mm.

6. A device according to claim 2, wherein each of the elastically deformable strips has a width of 1 mm to 5 mm.

7. A device according to claim 1, wherein at least one of the longitudinal edges of at least one slide is made of an elastomeric material, the tubular element being obtained by duplex injection molding.

8. A device according to claim 1, wherein the tubular element comprises a base with a closed bottom which reinforces the rigidity of the base.

9. A device according to claim 1, wherein the tubular element is made of a thermoplastic material chosen from the group comprising:

polyolefins, polystyrenes, polyacetates and cellulose propionate, vinyl polymers, polyacetals, and polyamides.

10. A device according to claim 2, wherein the cup comprises two stubs disposed in a diametrically opposed manner.

11. A device according to claim 3, wherein the cup comprises two stubs disposed in a diametrically opposed manner.

12. A device according to claim 2, wherein the difference between the width of each stub and the width of each slide is between 0.02 mm and 0.3 mm.

13. A device according to claim 3, wherein the difference between the width of each stub and the width of each slide is between 0.02 mm and 0.3 mm.

14. A device according to claim 4, wherein the difference between the width of each stub and the width of each slide is between 0.02 mm and 0.3 mm.

15. A device according to claim 3, wherein each elastically deformable strip has a width of 1 mm to 5 mm.

16. A device according to claim 4, wherein each elastically deformable strip has a width of 1 mm to 5 mm.

17. A device according to claim 5, wherein each elastically deformable strip has a width of 1 mm to 5 mm.

18. A device according to claim 2, wherein at least one of the longitudinal edges of at least one slide is made of an elastomeric material, the tubular element being obtained by duplex injection molding.

19. A device according to claim 3, wherein at least one of the longitudinal edges of at least one slide is made of an elastomeric material, the tubular element being obtained by duplex injection molding.

20. A device according to claim 4, wherein at least one of the longitudinal edges of at least one slide is made of an elastomeric material, the tubular element being obtained by duplex injection molding.

21. A device according to claim 1, wherein said soft friction is constantly ensured by the elastic deformation of said at least one slide tangential to the sides of the tubular element during the passing of said stub.

22. A device according to claim 3, wherein said soft friction is constantly ensured by the elastic deformation of said at least one slide tangential to the sides of the tubular element during the passing of said stub.

* * * * *